United States Patent [19]

Davis

[11] 4,062,293

[45] Dec. 13, 1977

[54] TROLLEY RIDE APPARATUS

[75] Inventor: Joseph I. Davis, Miami Shores, Fla.

[73] Assignee: Davis-Grabowski, Inc., Miami, Fla.

[21] Appl. No.: 665,126

[22] Filed: Mar. 8, 1976

[51] Int. Cl.[2] ..... B61B 12/02

[52] U.S. Cl. ..... 104/113

[58] Field of Search ..... 104/112, 113, 89, 93; 105/150, 151; 272/34, 35, 40

[56] References Cited

U.S. PATENT DOCUMENTS

| | | | |
|---|---|---|---|
| 399,283 | 3/1889 | Prittie | 104/113 |
| 407,835 | 7/1889 | Perry et al. | 104/113 |
| 1,463,165 | 7/1923 | Jack | 104/112 |
| 3,026,816 | 3/1962 | Russo et al. | 104/113 |
| 3,040,678 | 6/1962 | McEwen | 104/112 X |

*Primary Examiner*—Robert J. Spar
*Assistant Examiner*—Carl Rowold

[57] ABSTRACT

A trolley ride for sliding along a wire stretched between two uprights having a pair of identically molded plastic side members adapted to be bolted together with a pair of horizontally aligned pulleys rotatably mounted therebetween. Each side members have a tubular member extending outwardly for receiving a pipe that extends across the juncture of the side members for reinforcing the handles.

1 Claim, 4 Drawing Figures

TROLLEY RIDE APPARATUS

BACKGROUND OF THE INVENTION

1. Field of the Invention

This invention relates to an amusement device, especially for children and is more particularly directed to an improved trolley ride apparatus for exercise and entertainment of children.

2. Description of the Prior Art

The amusement devices known as trolley rides have heretofore been expensive in cost and complicated in design. It is a fact that because of their high cost, especially, none have been produced and sold on the open market in recent years as an amusement device for children. Ships at sea utilize a similar but more complicated and sophisticated apparatus for transferring persons from one ship to another while at sea. Likewise, rescue groups, such as firemen, mountain climbers and the like, use a similar apparatus in their rescue operations. However, none of these devices are suitable as an amusement device for children. Therefore, it is the intention of the present invention to provide a trolley ride for children.

BRIEF SUMMARY OF THE INVENTION

A principal object of the present invention is to provide a trolley ride for the amusement of children, which apparatus is simple in construction, inexpensive in cost, readily assembled by the average person and yet safe for use.

Another object of the present invention is to provide a trolley ride assembly consisting of a pair of identically molded side members when bolted together with a pair of rotatably mounted pulleys therebetween form the carrier adapted to slide along a wire that is stretched and fastened to a pair of upright members.

A further object of the present invention is to provide a plastic carrier for a trolley ride amusement device consisting of a pair of side members bolted together having aligned tubular members forming handles and extending outwardly therefrom, and having a pipe received by the tubular members for strengthening the handles.

With these and other objects in view, the invention will be best understood from a consideration of the following detailed description taken in connection with accompanying drawing forming a part of this specification, with the understanding, however, that the invention is not confined to any strict conformity with the showing of the drawing but may be changed or modified so long as such changes or modifications mark no material departure from the salient features of the invention as expressed in the appended claims.

DETAILED DESCRIPTION OF THE PREFERRED EMBODIMENT

Figure 1:
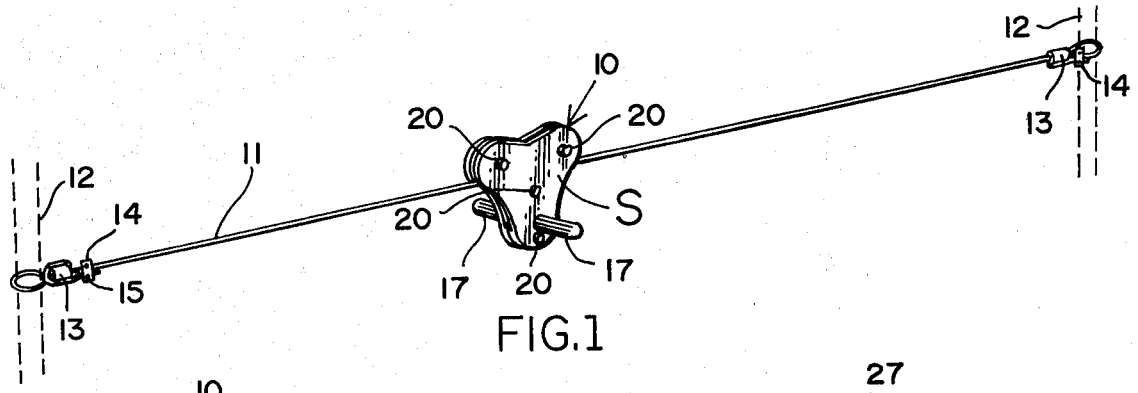
FIG. 1 is a perspective view of the trolley ride apparatus constructed in accordance with my invention and shown mounted on uprights shown by dotted lines.
Figure 2:
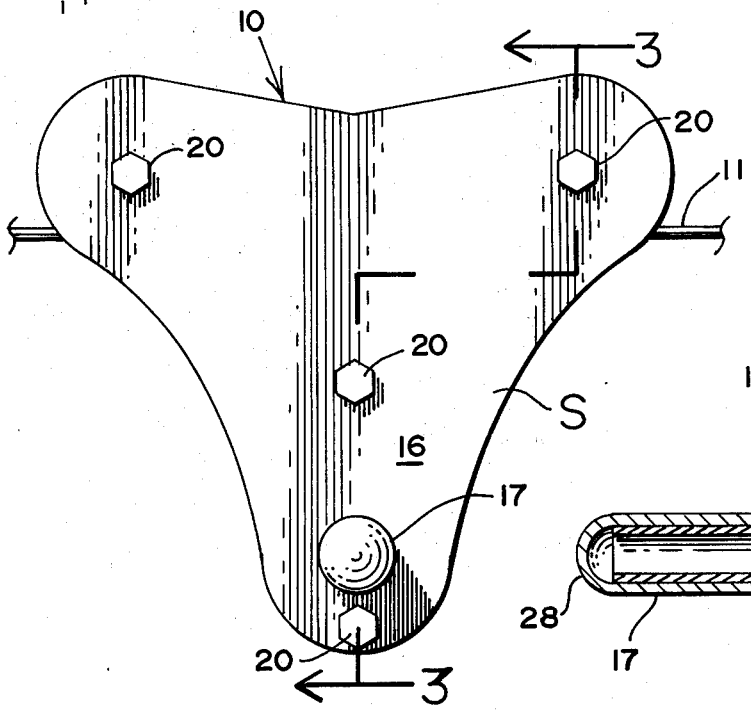
FIG. 2 is an enlarged side elevational view of the carrier.
Figure 3:
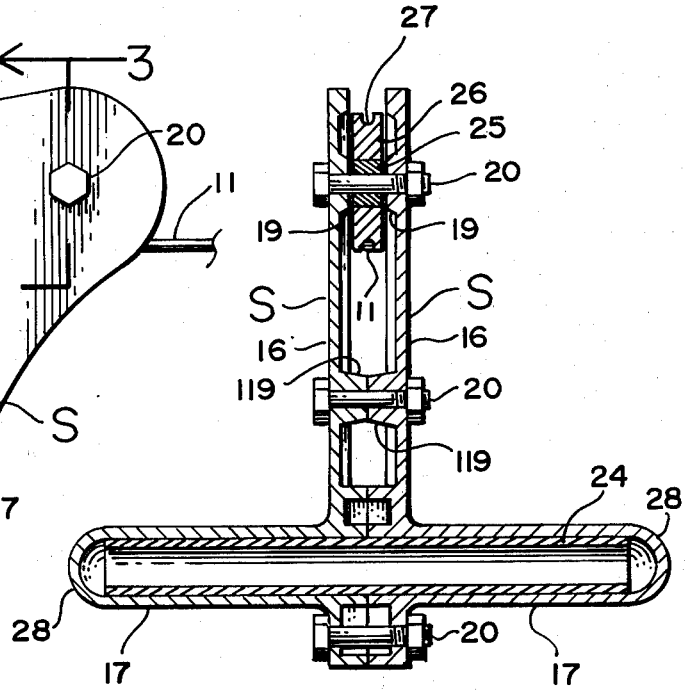
FIG. 3 is a cross sectional view taken along the lines 3—3 of FIG. 2.
Figure 4:
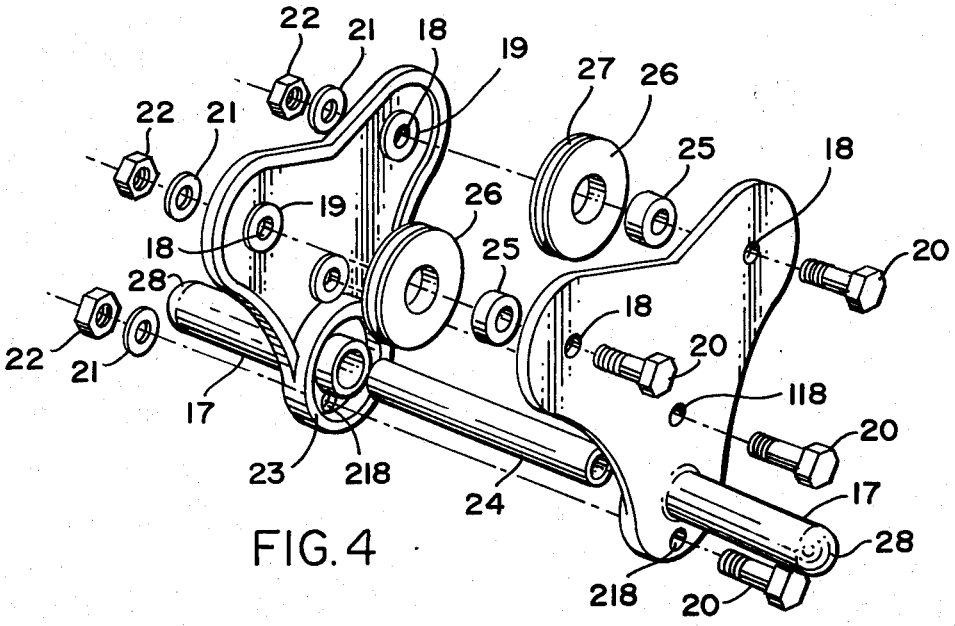
FIG. 4 is an exploded view of the carrier.

Referring to the drawing wherein like numerals are used to refer to similar parts throughout the several views, the numeral 10 refers to the carrier assembly constructed in accordance with my invention and slidably mounted on a wire or cable 11 that extends between uprights 12. The cable 11 is fastened at each of its ends to the uprights 12 by being threaded through a sleeve 13 about the upright 12 and rethreaded through the sleeve 13 with a conventional clamp 14 having bolts 15 securing the end of the cable 11 to the cable itself.

The carrier 10 consists of a pair of side frame members -S- each molded as a unit and consisting of a side wall portion 16 from which a tubular member 17 forming half of a handle extends at the lower portion thereof and having rounded end walls 28. The side walls 16 are each provided with a plurality of bores 18, 118, 218 for receiving bolts 20 therethrough. The bores 18 and 118 are provided with circumferential raised surfaces 19 and 119. The raised surfaces 119 bear against each other when the side frames 16 are fastened together, while the raised surfaces 19 bear against a bushing 25. Washers 21 and nuts 22 threaded on the bolts 20 secure the side walls 16 together. The tubular handles 17 which are also provided with a raised surface 23 at the inner surface of the side walls 16 bear against each other and receive a pipe 24 therein to strengthen the handles 17 when the carrier 10 had been assembled.

In alignment with each of the bores 18 there is positioned a bushing 25 about which a pulley 26 is rotatably mounted. The pulleys 26 are each provided with a peripheral groove 27 which receives the wire or cable 11 and permits the sliding of the carrier 10 along the wire 11.

After the wire 11 is fastened to the uprights and the carrier 10 assembled and mounted thereon as shown at slightly greater than the height of the user thereof, the person grasps the handles 17 in each of his hands, pushes off by running and then lifting his feet as the carrier 10 slides along the wire 11 to the opposite upright carrying the person. The carrier 10 is most effective to slide along the full length of the wire 11 when the latter is fixed to the upright at the same height with the wire 11 in a taut condition. After a good deal of use the wire 11 will stretch so that it will be necessary to refasten one end of the wire 11 periodically in order to maintain the wire 11 in a taut condition. It will be noted that when a person is being carried by the carrier 10 from one end of the wire 11 to the other end, the wire 11 will stretch momentarily by the weight of the user, causing the wire 11 to sag so that as the user slides toward and approaches the upright, the carrier 11 tends to slow down in speed and comes to a stop before reaching the upright 12.

As is readily noted by the above description taken in connection with the drawing, my trolley ride apparatus is provided with a carrier 10 that is simple in construction and relatively inexpensive in cost. The carrier 10 is readily assembled by the user by merely fastening together the identical housing side members -S- with the bolts 20 after having placed the pulleys 26 and their bushings 25 at the openings 18 and the pipe 24 within the handle members 17. The wire 11 is then secured at one end to one of the uprights 12 by means of the clamp 13, threaded through the carrier 10 and the stretched and secured in a similar manner to the other upright 12.

The trolley ride apparatus is now ready for the user to enjoy by being carried by the carrier 10 that slides back and forth along the wire 11.

What I claim as new and desire to secure by Letters patent is

1. A trolley ride apparatus for sliding along a wire stretched between two uprights comprising a pair of substantially identical side frame members having a flat side wall in substantially parallel relation to each other and one integrally formed tubular member forming handles extending outwardly from one side of the frame member and in axial alignment with the handle of the other frame member when the frames are joined, each of said tubular members being closed at its outer end portion, each of said side frame members having a plurality of bores extending therethrough, bolt means extending through two of said bores fastening said side frame members together, a pair of pulleys rotatably mounted on said bolt means between said pair of side walls and vertically above said tubular members, further bores extending through said side walls, raised surfaces formed about said further bores on each side frame members in contact engagement with opposing raised surfaces to maintain said side frame members in spaced relation to each other, fastening means extending through said further bores for securing said side walls together and pipe means extending along and contained within said tubular members for strengthening said handles.

* * * * *